US007339318B2

(12) United States Patent
Bettinelli et al.

(10) Patent No.: US 7,339,318 B2
(45) Date of Patent: Mar. 4, 2008

(54) PLATE FOR A PLASMA PANEL WITH REINFORCED POROUS BARRIERS

(75) Inventors: Armand Bettinelli, Coublevie (FR); Jean-Claude Martinez, Chartres de Bretagne (FR)

(73) Assignee: Thomson Licensing, Boulogne Billancourt (FR)

( * ) Notice: Subject to any disclaimer, the term of this patent is extended or adjusted under 35 U.S.C. 154(b) by 0 days.

(21) Appl. No.: 10/481,360

(22) PCT Filed: Jun. 4, 2002

(86) PCT No.: PCT/FR02/01868

§ 371 (c)(1),
(2), (4) Date: Dec. 18, 2003

(87) PCT Pub. No.: WO03/003398

PCT Pub. Date: Jan. 9, 2003

(65) Prior Publication Data

US 2004/0169471 A1 Sep. 2, 2004

(30) Foreign Application Priority Data

Jun. 29, 2001 (FR) ..... 01 08628
Sep. 21, 2001 (FR) ..... 01 12250

(51) Int. Cl.

| | |
|---|---|
| ***H01J 17/04*** | (2006.01) |
| ***H01J 17/16*** | (2006.01) |
| ***H01J 9/02*** | (2006.01) |
| ***H01J 17/09*** | (2006.01) |
| ***H01J 9/24*** | (2006.01) |

(52) U.S. Cl. ..... 313/581; 313/113; 445/24; 445/57

(58) Field of Classification Search ..... 313/582–587, 313/113; 445/24, 40, 57

See application file for complete search history.

(56) References Cited

U.S. PATENT DOCUMENTS

| | | | | |
|---|---|---|---|---|
| 5,698,944 | A * | 12/1997 | Togawa | 313/582 |
| 5,909,083 | A | 6/1999 | Asano et al. | 313/584 |
| 6,207,268 | B1 | 3/2001 | Kosaka et al. | 428/325 |
| 7,131,880 | B2 * | 11/2006 | Bettinelli et al. | 445/24 |

FOREIGN PATENT DOCUMENTS

| | | |
|---|---|---|
| JP | 10-144206 | 5/1998 |
| JP | 11-306967 | 11/1999 |

OTHER PUBLICATIONS

Patent Abstract of Japan Pub No. 11219659; Pub Date Aug. 10, 1999.

Patent Abstract of Japan Pub No. 07045200; Pub Date Feb. 14, 1995.

Patent Abstract of Japan Pub. No. 2000100327; Pub Date Apr. 7, 2000 & JP 2000-100327.

* cited by examiner

*Primary Examiner*—Ashok Patel
(74) *Attorney, Agent, or Firm*—Joseph J. Laks; Harvey Fried; Patricia Verlangieri

(57) ABSTRACT

Tile comprising a substrate coated with at least one array of electrodes which is itself coated with an array of barrier ribs made of a mineral material, the porosity of which is greater than 25%, comprising a porous base underlayer which is inserted between the array of electrodes and the array of barrier ribs and which is made of a mineral material, the porosity of which is greater than 25%. Reinforced porous barrier ribs are obtained; advantageously, this tile does not include a specific dielectric layer; the number of manufacturing steps is limited and the tile can be manufactured entirely at low temperature.

20 Claims, 1 Drawing Sheet

PLATE FOR A PLASMA PANEL WITH REINFORCED POROUS BARRIERS

Figure 1:
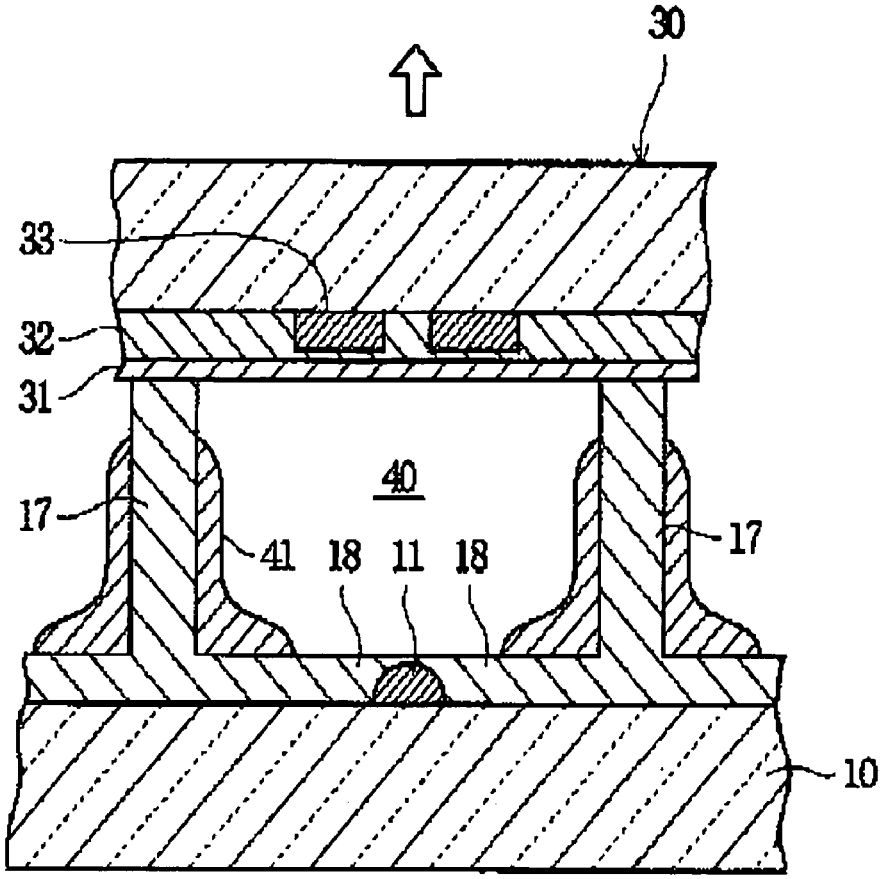

This application claims the benefit, under 35 U.S.C. § 365 of International Application PCT/FR02/018684, filed Jun. 4, 2002, which was published in accordance with PCT Article 21(2) on Jan. 9, 2003 in French and which claims the benefit of French patent application No. 0108628, filed Jun. 29, 2001 and French patent application No. 0112250, filed Sep. 21, 2001.

The invention relates to a tile for a plasma image display panel comprising a substrate coated with at least one array of electrodes which is itself coated with an array of barrier ribs of high porosity; document EP 1 017 083 (THOMSON) discloses such tiles.

Conventionally, the barrier ribs are intended to define cells for forming discharge regions in the plasma panel.

Among the advantages of porous barrier ribs, we mention the following:

- the possibility of producing them at a lower temperature than the dense conventional barrier ribs, the porosity of which does not exceed 2%;
- the ease of pumping the plasma panel; after the two tiles have been joined together so as to leave between them discharge regions bounded by the barrier ribs, it is necessary to pump and remove the gas found between the tiles and then to inject the discharge gas into the pumped space; when the barrier ribs are dense, the pumping step lasts many hours, if not tens of hours, this being highly detrimental from the economic standpoint; using highly porous barrier ribs, of open porosity, the pumping time is considerably shortened.

Tiles of this type generally serve as the rear tile of a plasma panel; to manufacture the plasma panel, it is general practice to apply, on the tops of the barrier ribs of a tile of this type, a transparent front tile also provided with at least one array of electrodes oriented orthogonally to the electrodes of the rear tile; at the intersections of the electrodes of the rear tile with the electrodes of the front tile, the regions bounded by the walls of the barrier ribs, by the rear tile and by the front tile form regions of light discharges produced by applying suitable potential differences between the electrodes crossing these regions.

To manufacture an AC plasma panel with a memory effect and with coplanar electrodes, the front tile is provided with an array of pairs of coplanar electrodes coated with a dielectric layer; the electrodes of the rear tile are also generally covered with a dielectric layer; the plasma panel then comprises a system for electrically supplying the electrodes suitable:

- during the so-called addressing periods, for creating electrical charges on the dielectric layer of the front tile in the discharge regions to be activated; and
- during the so-called sustain periods, for activating series of sustain light discharges only in these charged regions by applying series of voltage pulses between each pair of electrodes beneath the dielectric layer.

The electrodes of the tile provided with the array of barrier ribs, opposite the array of pairs of electrodes, then generally serve for activating the discharge regions, that is to say for addressing the cells.

To prevent electrical breakdown and to protect the tiles against the action and corrosion of the discharges, the dielectric layers applied to each tile are made of a dense material generally based on a mineral glass containing lead, allowing it to be baked in the 500-600° C. range.

Thus, the process for manufacturing a tile of the above-mentioned type comprises, after the array of electrodes has been formed and before the green layer of barrier rib material has been deposited, the deposition of a green layer of uniform thickness based on a powder of a mineral dielectric and on an organic binder generally followed by a baking step under conditions suitable for removing the organic binder and for densifying this dielectric.

The dielectric layer thus densified also has the function of protecting the electrodes while abrasive material is being sprayed in order to form the barrier ribs.

However, this additional step relating to the application and to the baking of a dielectric layer adversely affects the economics.

Moreover, the porous barrier ribs are not without drawbacks: by dint of their structure, they are more fragile or weaker than the conventional dense barrier ribs; this effect is accentuated in the case of narrow barrier ribs, especially those with a width of less than or equal to 70 μm.

The object of the invention is to provide a tile of the aforementioned type, of simpler structure and provided with reinforced porous barrier ribs, which can be produced by a more economic process.

For this purpose, the subject of the invention is a tile for a plasma image display panel comprising a substrate coated with at least one array of electrodes which is itself coated with an array of barrier ribs made of a mineral material, the porosity of which is greater than 25%, these being intended to define cells in order to form discharge regions in the said panel, characterized in that it comprises a porous base underlayer which is inserted between the said array of electrodes and the said array of barrier ribs, which is made of a mineral material, the porosity of which is greater than 25%.

Each barrier rib conventionally comprises a base, sides and a top; the base underlayer completely covers the electrodes in the active surface region of the tile; the term "active surface region of the tile" is understood to mean that which corresponds to the cells of the panel.

It has been found that:

- the base underlayer makes it possible for the stability of the porous barrier ribs and their adhesion to the substrate to be substantially improved;
- obtaining such underlayers is particularly economic because it is easier to obtain porous underlayers at low temperature than non-porous underlayers.

The adhesion of the barrier ribs to the substrate is more critical when the substrate has a low roughness and the barrier ribs have a high porosity; thanks to the underlayer according to the invention, the barrier ribs bear on the entire surface of the substrate via the underlayer, thereby improving the stability of the barrier ribs and their adhesion to the substrate.

Compared with dense barrier ribs having a high proportion of glass, porous barrier ribs also have problems of mechanical stability and of adhesion to the substrate; since these substrates are generally made of glass, it will be understood that a porous material adheres to the glass with greater difficulty than the vitreous material of dense barrier ribs; the addition of a base underlayer according to the invention, which extends, both before and after baking, over the entire useful surface of the tile, makes it possible to improve the mechanical stability of the barrier ribs and the adhesion of these barrier ribs to the substrate, especially when these are narrow and porous; the base underlayer according to the invention therefore also has the function of anchoring the barrier ribs onto the tile, whether before or after baking; this anchoring advantage is particularly beneficial if the formation of the barrier ribs—in the green, that is to say unbaked, state—comprises a sandblasting step (see below) which requires the prior application of a protective mask having the features of the array of barrier ribs and which is followed by a step of removing this protective mask since, during this step, there is most particularly a risk of weakening or destabilizing these barrier ribs.

Preferably, the width of the barrier ribs is less than or equal to 70 μm, especially at the sides; this is because such barrier ribs are particularly weak, whether in the baked state or in the green state before baking, during manufacture of the tile; the underlayer according to the invention is then even more useful for reinforcing these barrier ribs; in the case of barrier ribs having sloping sides, the width is measured at mid-height.

Preferably, the thickness of the base underlayer is between 10 μm and 40 μm at every point of the tile, i.e. at every point of the active surface of this tile corresponding to the whole discharge regions; the bottom of the cells of the tile is then formed by the surface of the base underlayer, which has no hole exposing electrode regions or substrate regions of the tile.

Preferably, the tile has no interlayer, especially a dielectric interlayer, between the electrodes and the said base underlayer.

The base underlayer which forms the bottom of the cells is sufficient to protect the electrodes from the action of and the erosion by the plasma discharges, even if it is porous; this is because such erosion is slight as the proportion of discharges initiated at the start of the electrodes of the tile according to the invention is small compared with the total number of discharges on a plasma panel having a tile according to the invention in normal use.

In fact, when images are being displayed on such a panel provided, for example, on the rear face with a tile according to the invention and, on the front face, with a tile having an array of pairs of coplanar electrodes coated with a dielectric layer, most of the discharges take place between the paired electrodes of the front tile (coplanar discharges), far from the tile according to the invention; these discharges, which spring between the pairs of coplanar electrodes, are termed sustain discharges; between the sustain periods, discharges may take place between the opposed electrodes of the two tiles, and therefore especially near the electrodes of the tile according to the invention; these discharges are especially intended to activate the cells of the panel; they are usually called address discharges and merely constitute a minor proportion of the total number of discharges; the base underlayer which covers the electrodes of the tile according to the invention is sufficient, although porous, to protect them from the action of and the corrosion by the address discharges; the dielectric layer of the front face is then generally sufficiently dense to avoid, by itself, any risk of breakdown and to ensure, when necessary, the conventional memory effect of AC panels.

According to a variant, the base underlayer includes a component suitable for reflecting the light; it is preferred to use titanium oxide for this purpose.

Thanks to the reflecting effect thus obtained, the radiation emitted towards the bottom of the cells is not lost and the luminous efficiency of the plasma panels comprising a tile according to the invention is increased.

The base underlayer according to the invention therefore has three functions, namely to protect the electrodes during manufacture of the panel (see below), to anchor the barrier ribs and to improve the luminous efficiency; the use of a single underlayer for three functions is particularly advantageous from the economic standpoint since this avoids having to interpose a specific dielectric layer and a specific reflection layer.

The barrier ribs may also include a reflecting component to improve the luminous efficiency.

Advantageously, to obtain porous barrier ribs, when the mineral material of the base underlayer comprises a mineral filler and a mineral binder, the proportion by weight of mineral binder in the mineral material of the barrier ribs is less than 13%.

Preferably, when the mineral material of the base underlayer comprises a mineral filler and optionally a mineral binder, the proportion by weight of mineral binder in the mineral material of the base underlayer is less than 13%; this is a preferred way of obtaining a porous underlayer; if in particular the electrodes are made of silver and the underlayer and/or the barrier ribs have a reflection function in order to improve the luminous efficiency, this low mineral binder content prevents the migration of silver into this underlayer and into the barrier ribs and prevents coloration especially yellowing, of the mineral material, which would degrade its reflection properties.

According to another variant, the material of the base underlayer is identical to the material of the barrier ribs. This simplifies the manufacture of the tile.

Without departing from the invention, the tile may comprise several base underlayers, one of the same material as that of the barrier ribs and another which includes a component suitable for reflecting the light.

Preferably, the tile according to the invention includes a layer of phosphors at least partly covering the sides of the barrier ribs and the said underlayer.

The nature of the phosphors of this layer generally differs according to the rows or columns of cells bounded by the barrier ribs; the phosphors thus deposited on the walls of the cells have the function of converting the ultraviolet radiation of the discharges into visible radiation in one of the three primary colours conventionally used to display images; in general, adjacent cells provided with different primary colours form a picture element or pixel.

Preferably, these phosphors are deposited directly on the porous underlayer and the porous barrier ribs; it has been found that this porosity favours the adhesion of the phosphors; no adhesion interlayer is then necessary.

Preferably, at every point on the surface joining the base of the barrier ribs to the base underlayer, the radius of curvature is greater than or equal to 10 μm; it has been found that such a radius of curvature is even more favourable to the stability of the barrier ribs, but also to the uniformity of deposition of the phosphors.

Preferably, the barrier ribs are themselves coated with an overlayer; as described in documents EP 722 179, EP 893 813 and U.S. Pat. No. 5,909,083, this overlayer on the top of the barrier ribs is, for example, intended to:

- form a protective mask when the barrier ribs are formed by sandblasting (see below);
- and/or form a black matrix and/or form a layer which compensates for irregularities in the height of the barrier ribs.

The subject of the invention is also a plasma image display panel, of the AC type and with a memory effect, comprising a first tile according to the invention and a second tile provided with coplanar electrodes serving to sustain the discharges by the memory effect, providing between the tiles discharge regions bounded by the said barrier ribs.

The subject of the invention is also a process for manufacturing a plasma panel tile according to the invention, characterized in that it comprises the following steps:

formation of at least one array of electrodes on a substrate;

deposition, on the said array of electrodes and on the substrate, of at least a green base underlayer and a superposed green main layer, both the underlayer and the main layer being based on a powder blend of a mineral material and an organic binder;

blasting with an abrasive material:

≅so as to remove part of the said green main layer in order to form the said array of green barrier ribs, the said barrier ribs comprising a base, a top and sides, and ≅so as to avoid, if not limit, the removal of the said green base underlayer so that there is not one hole over the entire coating;

baking under conditions suitable for removing the organic binder and for consolidating the mineral material of the barrier ribs and of the said base underlayer, the composition and the thickness of the said green base underlayer being suitable for the rate of abrasion of this underlayer to be less than the rate of abrasion of the main layer under the conditions of the said blasting.

The base underlayer and the main layer are deposited on the initial tile, or substrate, provided with its array of electrodes, so as for each to have an approximately uniform thickness over the active surface of the tile.

The rate of abrasion of the underlayer is, according to the invention, less than the rate of abrasion of the main layer under comparable abrasion conditions, namely the use of the same abrasive material under the same operating conditions as during blasting in order to form the barrier ribs.

Thus, after the step of forming the barrier ribs by blasting with an abrasive material and after discharge cells bounded by these barrier ribs have been obtained on the substrate, the bottom of these cells is then formed by the surface of the base underlayer, which has not one hole exposing electrode or substrate regions; the base underlayer may be partly etched by the abrasive material but must have resisted it sufficiently for the electrodes of the tile to be entirely covered with this base underlayer; the base underlayer therefore has mainly the function, at this point, of protecting the underlying electrodes during formation of the green barrier ribs by blasting with an abrasive material; after baking, the bottom of the cells is still formed by the surface of the baked base underlayer.

The base underlayer mineral material comprises a mineral filler and optionally a mineral binder; the particle size of the powder of the mineral material of this underlayer, especially of the said mineral filler, when appropriate, the nature of the said mineral binder and the proportions of this binder in this powder, the method of blending the components of this powder and the baking conditions are suitable for the bulk density of the base underlayer obtained after baking to be less than or equal to 75% of the theoretical density of the mineral filler of this underlayer.

For this purpose, the proportion of mineral binder in the mineral material of the base underlayer is preferably less than 13%; this proportion may even in this case be zero.

Thanks to this underlayer thus having a porosity of greater than 25% and, if the array of electrodes has been formed by depositing a green layer comprising a conducting material and an organic binder, it is even easier to bake this layer of electrodes at the end of the process, at the same time as the green base underlayer and green barrier ribs are baked, because the porosity of this base underlayer and that of the barrier ribs make it easier to remove the decomposition products of the organic binders, including those of the layer of electrodes.

After deposition of the base underlayer and of the main layer and before the abrasion operation, it is general practice to apply to this coating a protective mask made of polymer material provided with patterns corresponding to the array of barrier ribs to be formed; the purpose of this mask is to protect those regions of the main layer corresponding to the tops of the barrier ribs from being abraded; thus, after the abrasion operation but before the baking and, where appropriate, before other operations such as the deposition of phosphors, this mask is stripped off, generally by spraying an aqueous alkaline solution.

It has been noted that it is preferably for the radius of curvature to be greater than or equal to 10 μm at all points on the surface joining the base of the barrier ribs to the base underlayer; this radius of curvature is larger the smaller the difference between the rate of abrasion of the base underlayer and that of the main barrier rib layer.

As in conventional processes for manufacturing an array of barrier ribs on a tile, an organic binder which can be easily removed during baking will be chosen for the base underlayer and for the main layer; when this base underlayer and the main layer are applied using liquid in a solvent medium, a binder will be chosen which is soluble in a solvent that is easy to remove without any hazard; when a mask is applied before sandblasting and this mask is then removed by spraying with an aqueous alkaline solution, it will be preferred to choose a water-resistant organic binder, preferably chosen from the group comprising cellulosic resins, acrylic resins, methacrylic resins, rosin resins and resins based on crosslinked polyvinyl alcohol; preferably, the organic binder of the base underlayer is based on polyvinyl alcohol.

Preferably, in particular when the organic binder of the base underlayer is of the same family as that of the main layer, the proportion of organic binder in the base underlayer is greater than the proportion of organic binder in the main layer.

Preferably, the glass transition temperature of the organic binder of the base underlayer is lower than that of the organic binder of the main layer, especially less than or equal to 60° C.

Preferably, the process according to the invention does not include the deposition of an interlayer, especially a dielectric interlayer, between formation of the array of electrodes and deposition of the base underlayer; by avoiding the application of a dielectric interlayer, the process according to the invention is therefore much more economic than the processes of the prior art.

Preferably, the process according to the invention includes only a single baking heat treatment after the at least one array of electrodes has been formed.

If the array of electrodes is formed by depositing a green layer comprising a conducting material, for example one based on silver, aluminium or copper, and an organic binder, the process according to the invention advantageously includes only a single final baking, without intermediate baking between deposition of the green layer of electrodes and deposition of the base underlayer; thanks to the porosity of the underlayer, the decomposition products coming from the organic binder of the array of electrodes easily pass through this underlayer without damaging it; the almost non-vitreous character of this underlayer prevents, during baking, the phenomenon of parasitic diffusion of the material of the electrodes; advantageously, it is no longer necessary to bake the array of electrodes before the barrier ribs are deposited.

Preferably, the process according to the invention includes no step during which the temperature of the tile exceeds 480°.

The mineral barrier rib material comprises a mineral barrier rib filler and a mineral binder; the particle size of the powder of this mineral material, especially of the mineral barrier rib filler, the nature of its mineral binder and the proportions of this binder in this powder, the method of blending the components of this powder and the baking conditions are suitable for the bulk density of the barrier ribs obtained after baking to be less than 75% of the theoretical density of the said mineral filler; in this way barrier ribs whose porosity is greater than 25% are obtained, which advantageously facilitates and shortens the pumping of the plasma panel.

To obtain barrier ribs whose bulk density is, after baking, less than 75% of the theoretical density of the material of their mineral filler, that is to say barrier ribs having a porosity of greater than 25%, it is preferred to use for these barrier ribs a material in which the proportion by weight of mineral binder is less than 13%; as mineral binder, a glass or frit with a low melting point is generally used; in the case of these low proportions of mineral binder, the mineral binder advantageously comprises colloidal silica or hydrolysed silanes or silicates, which improve the strength of the porous barrier ribs.

Advantageously, the process comprises the deposition of a phosphor-based green layer and of an organic binder, both on the green underlayer covering the array of electrodes and on the base and sides of the barrier ribs; this step is in itself known from the prior art; thanks to the invention, the green layer of phosphors wets in the same way the walls of the barrier ribs and the bottom of the cells since they consist of identical materials; thus, more uniform distribution and better homogeneity of the phosphors are obtained; after baking, better adhesion of the phosphors to the walls of the barrier ribs and to the bottom of the cells is obtained, without using an adhesion interlayer.

Figure 2:
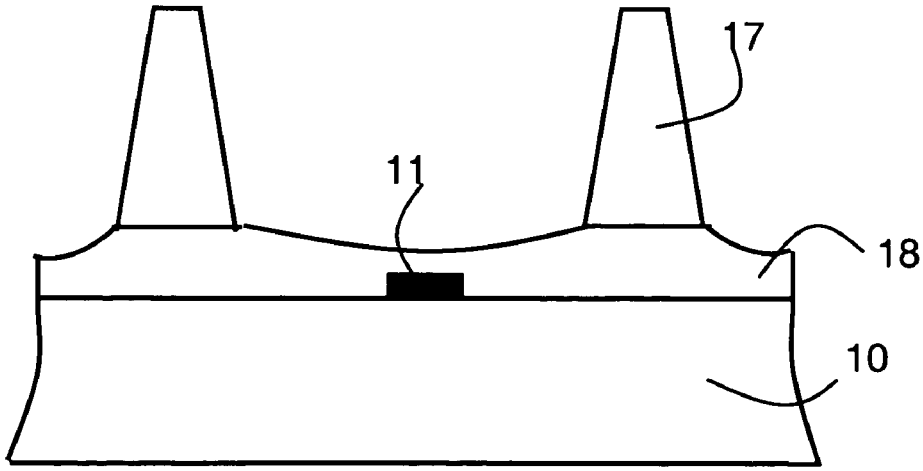

The invention will be more clearly understood on reading the description which follows, given by way of non-limiting example and with reference to FIG. 1, which describes a plasma panel provided with a tile with an underlayer according to one embodiment of the invention, and to FIG. 2, which describes a tile with an underlayer according to another embodiment of the invention; to simplify the figures, identical references are used for the elements which provide the same functions.

The process starts with a conventional tile 10, generally made of soda lime glass; other insulating materials may be used for the tile, provided that they withstand the baking temperatures.

An array of electrodes 11 is applied in a manner known per se to this tile using, for example, one of the following conventional methods:

direct screen printing of a paste in order to form an array of green electrodes, this paste being based on a powder of conducting material and of an organic binder followed by baking of the green electrodes, suitable for removing the organic binder and, if necessary, to sinter the conducting powder and to obtain optimum conductivity of the electrodes;

using a photosensitive binder in the paste, application of a uniform paste layer followed by photolithography and development, in order to obtain the array of green electrodes; then baking under the same conditions as above; and vacuum deposition of at least one uniform layer of conducting material, generally a metal or an alloy, deposition of a homogeneous photosensitive organic layer, which is protective and able to withstand the stripping after photosensitization, photolithography to sensitize the layer and render it protective at the electrodes, stripping of the non-sensitized parts in order to etch the underlying metal layer regions so as to obtain the array of electrodes made of conducting material, and removal of the residual photosensitive layer; this process therefore includes no baking.

Next, the steps of forming the array of barrier ribs are carried out.

The powder of barrier rib material generally comprises a mineral filler and a glass-based mineral binder; the temperature reached when baking the barrier ribs is generally greater than or equal to the glass transition temperature of the glass, so as to activate the mineral binder and to obtain sufficient consolidation after the organic binder has been removed; to obtain a barrier rib material of high porosity, especially greater than 25%, the weight content of this glass in the powder of barrier rib material will preferably be greater than or equal to 2% and less than or equal to 10%; this content will be higher the narrower the barrier ribs.

The powder of base underlayer material also comprises a mineral filler and, optionally, a glass-based mineral binder.

The mineral filler of the barrier rib material is chosen from mineral substances stable within the baking temperature ranges and having a high adsorptivity; preferably, this filler is chosen from the group comprising alumina, zirconia, yttrium oxide, titanium oxide and mixtures thereof; alumina especially because this is an amphoteric powder having high adsorption properties; zirconia or titanium oxide depending on the desired dielectric constant; the mineral filler may also comprise substances such as mullite, cordierite or zeolites; preferably, 80% of the individual particles of the mineral filler have a size of between 0.3 μm and 10 μm; after baking, the particle size is generally unchanged.

The mineral filler of the underlayer material may be identical to or different from that of the barrier rib material; according to one variant of the invention, this mineral filler includes components other than the mineral filler intended for the main layer of barrier ribs, such as for example a light-reflecting material; to form a reflecting white background at the bottom of the discharge cells, titanium oxide may be used as the other component.

Preferably, the mean particle size of the mineral binder is less than or equal to that of the mineral filler.

According to the invention, to obtain a base underlayer material having a high porosity, especially greater than 25%, the weight content of optional mineral binder in the powder of base underlayer material will preferably be less than 13%; the powder of base underlayer material may contain no mineral binder.

Next, when appropriate, the mineral filler is blended with the mineral binder to obtain the powder of barrier rib material or the powder of base underlayer material; since the proportions of the two main mineral components of this powder are very different, the method of blending them is very important in order to optimize the dispersion of the mineral binder around the particles of the mineral filler and to allow it to provide substantial consolidation of the barrier ribs during the baking step; a typical method of blending about 1 liter of powder consists in placing this powder in an approximately 4-liter container and stirring it dry using a knife 150 mm in diameter rotating at 7000 revolutions/minute for about 4 minutes.

The organic binders are preferably chosen from the group comprising cellulosic resins, acrylic resins, methacrylic resins, rosin resins and resins based on crosslinked polyvinyl alcohol.

Preferably, the composition of the green base underlayer is designed so that the rate of abrasion of the base underlayer is markedly less than the rate of abrasion of the main layer under the same blasting conditions; the rate of abrasion of a green layer or underlayer under predetermined conditions of blasting with abrasive material generally decreases when the proportion of organic binder in this layer increases, and/or when the intrinsic elasticity of this binder increases.

By carrying out routine tests, a person skilled in the art will be able to develop green layer formulations possessing different rates of abrasion under predetermined conditions of blasting with abrasive material; the expression "conditions of blasting" should be understood to mean not only the conditions under which the abrasive material is used but also the nature, texture and structure of this material.

To design the composition of the green base underlayer for this purpose, it will be possible, for example, to use for the green main barrier rib layer an organic binder much more sensitive to abrasion than that of the base underlayer; as particularly abrasion-sensitive binder, it will be preferred to use rosin.

One advantageous solution consists in using for the underlayer an organic binder based on UV-crosslinkable polyvinyl alcohol.

When polyvinyl alcohol is used as organic binder of the underlayer, abrasion tests have shown that the rate of abrasion decreases by 50% when the content of organic binder in the base underlayer goes from 5 to 10%.

To design the composition of the green base underlayer for this purpose, it will be preferable to use for this underlayer an organic binder having a glass transition temperature below that of the binder of the main layer; thus, an organic binder having a glass transition temperature of less than or equal to 60° C. may advantageously be used; for example, a highly abrasion-resistant base underlayer is obtained by using as organic binder 4% by weight of an acrylic or methacrylic resin having a glass transition temperature of 57° C.

To design the composition of the green base underlayer for this purpose, using the same organic binder for the main layer and for the base underlayer, the base underlayer will, for example, be formulated with an organic binder content 2.5 to 8 times higher than in the main layer: for example, taking as binder grade N4 ethyl cellulose having a glass transition temperature of around 156° C., the proportion (weight of binder/weight of mineral powder) would be 2 to 4% in the main layer compared with 10 to 15% in the base underlayer.

By using the same organic binder family for the main layer and for the base underlayer, the abradability of the main barrier rib layer may be increased by using a binder of higher molecular weight; thus, it will be preferred to use a grade having a lower molecular weight in the base underlayer than in the main layer.

To increase the elasticity of the binder of the base underlayer under the conditions of blasting with the abrasive material and to give this underlayer better abrasion resistance, it will be preferred to add a plasticizing agent to the organic binder of this underlayer, the said plasticizing agent being tailored to the said binder, avoiding too high a content which would risk causing the green underlayer to crack after application; with the abovementioned grade N4 ethyl cellulose, it is possible to use from 1 to 4% by weight (again with respect to the weight of mineral powder) of benzyl butyl phthalate.

When polyvinyl alcohol is used as organic binder, abrasion tests have shown that the rate of abrasion decreases by 25% when 5% of plasticizer is added to this binder; the plasticizer content must remain limited, typically less than 25%, in order not to compromise the baked mechanical strength of this underlayer producing the base of the barrier ribs.

Again for the same purpose, any other means of lowering the glass transition temperature of this binder in the base underlayer, measured in the crosslinked state, may be used.

The powder of barrier rib material or of underlayer material is therefore blended, in a manner known per se, with its organic binder.

The green barrier rib layers may then be deposited directly on the tile provided with its array of electrodes by a liquid process, or by transfer of a green tape of this preformed layer, as described in document EP 722179 (DuPont).

Liquid deposition will now be more specifically described here; as liquid deposition process, it is possible to use, for example, screen printing, slit coating or curtain coating.

Before the deposition operations, the following are prepared:

1. a liquid composition or paste for applying the main layer, by dispersing the powder of barrier rib material in a solution of an organic binder;
2. a liquid composition or paste for applying the base underlayer, by dispersing the powder of barrier rib material in a solution of an organic binder.

To apply the entire green barrier rib layer to the tile, on the side containing the electrodes, the following procedure is carried out:

an underlayer of the base underlayer application composition is applied in manner known per se so as, after drying, to obtain a thickness of generally between 10 and 40 μm;

the base underlayer obtained is dried in order to evaporate the solvent therefrom;

next, at least one layer of the main layer application composition is applied in a manner known per se so as, after drying, to obtain a main layer with a thickness which depends on the height of the desired barrier ribs; and the main layer obtained is dried in order to evaporate the solvent therefrom.

A tile provided with an array of electrodes coated with a base underlayer and with a green barrier rib layer of uniform overall thickness is obtained.

The next steps relate to the formation of the barrier ribs.

A solid powder or "sand" is generally used as abrasive material, such as for example glass beads, metal shot or calcium carbonate powder; the operation is then termed sandblasting; it is also possible to use a liquid as abrasive material.

It is therefore sought to form green barrier ribs in the green main layer with which the tile is now provided; the procedure is therefore to remove the green layer by abrasion only between the barrier ribs and, in contrast, to protect this layer from the abrasion at the place of the barrier ribs.

For this purpose, a first conventional method consists in:

applying, to the green barrier rib layer, a protective mask made of a polymer material provided with patterns corresponding to the array of barrier ribs to be formed;

blasting the abrasive material so as to remove the green layer between the patterns of the mask and to form the green barrier ribs at these patterns; and removing the mask.

The mask may be made, for example, by direct screen printing, but this method has the drawback of offering limited definition; this mask may also be produced by photolithography of a photocurable or photosensitive polymer layer, for example according to the following steps: whole-area coating, UV exposure through a mask and development (generally using a sodium carbonate solution).

Advantageously, the polymer material of the mask is based on crosslinked polyvinyl alcohol (PVA); the advantage of this material is that it can be developed in hot water, thereby dispensing with the use of a solution containing alkali metal elements, that it is particularly abrasion-resistant and that it can be easily removed by burning or pyrolysis after the abrasion operation; this method of removal, compared with a conventional stripping operation, prevents the barrier ribs from being weakened and avoids envisaging even narrower barrier ribs; by using this method of removal, the use of a mask-stripping solution containing sodium or potassium with all the risks inherent in tile contamination, is again avoided, the more so as a large developed surface difficult to rinse has been generated when sandblasting barrier ribs; a very high abrasion resistance is obtained with contents of (PVA+plasticizer) of 100%, with a plasticizer/resin ratio of 1 to 2.

Another method described in the abovementioned document EP 722179 consists in applying, to the main layer of barrier rib material, an overlayer not only filled with a barrier rib material but also containing a sufficiently large proportion of photocurable organic binder in order to be able to withstand the blasting with abrasive material; thus, it is in the overlayer itself that the mask is produced by photolithography; according to that document EP 722179, the advantage of this method is that it is unnecessary to remove the mask directly after the abrasion operation since the photocured binder is removed subsequently, during the baking operation, its pyrolysis being facilitated by the porosity of the mineral filler; after baking, the remaining part of this overlayer forms the top of the barrier ribs.

Advantageously, the photocurable organic binder of the overlayer is based on crosslinked polyvinyl alcohol; the advantage of this material is that it is particularly abrasion-resistant; very high abrasion resistance has been obtained with typical (PVA+plasticizer) contents of 20 to 50%; typically with a plasticizer/resin content of 1 to 2.

Further variants applicable to the invention relate to the use of an overlayer intended to form the top of the barrier ribs:

as described in the documents EP 722179 and EP 893813, a black pigment, such as cobalt and iron oxide, may be introduced into the mineral powder of this overlayer so that, after baking, the top of the barrier ribs forms a black matrix intended to improve the image display contrast of the plasma panel; and as described in document EP 893813, the proportion of mineral binder in this overlayer may be much lower than in the main layer, or even zero, so that the top of the barrier ribs can be slightly compressed when one tile is joined to another tile in order to form a plasma panel, this compression being intended to compensate for the irregularities in height of the barrier ribs and to improve the sealing of the junction with the other tile all along the barrier ribs.

A tile is therefore obtained which is provided with an array of electrodes and with an array of green barrier ribs that define the future discharge regions or cells of the plasma panel, in which the bottom of the cells and the electrodes crossing the bottom of the cells are covered with the base underlayer which has resisted the blasting with abrasive material and has therefore served, according to the invention, to protect the electrodes from the blasting with abrasive material in the absence of a dielectric layer.

The tile provided with an array of green barrier ribs supported by a green base underlayer is then ready for the operations of depositing the green layer of phosphors on the sides of the barrier ribs and on the base underlayer at the bottom of the cells; for a deposition operation, it is preferred to use the conventional technique of direct screen printing, carrying out the following steps:

preparation of a liquid paste essentially comprising the phosphor to be applied, an organic binder and at least one solvent or a suspension liquid not dissolving the binder of the green barrier ribs and the binder of their green underlayer;

application of this paste to the tile through a screen-printing screen having apertures facing the regions to be covered with this phosphor; and evaporation of the solvent.

By repeating these operations for each type of phosphor to be applied, a tile provided with an array of electrodes and with an array of barrier ribs coated with phosphors is then obtained.

To deposit the phosphors, it will also be possible to use the photolithography technique which allows better definition, combined with whole-area coating, for example by spraying, in order to limit the mechanical stresses applied to the sides of the barrier ribs; nevertheless, this technique involves substantial scrapping of material containing phosphors and expensive operations to recycle this scrap; other deposition techniques may be used, for example application by means of inkjets, dispensing with a syringe, or microdosing.

The whole assembly, comprising the green underlayer, the green barrier ribs and the green layers of phosphors, is then baked under conditions suitable for removing the organic binder from the various green layers and, in the case of the barrier ribs and their base underlayer, to consolidate the mineral material; the organic compounds are generally removed at below 380° C. and this is achieved, in a first baking heat treatment, with a gradual rise up to this temperature so as to remove these organic compounds without damaging the structure of the green layers; in a second heat treatment step, the assembly is heated up to at least a temperature close to the softening temperature of the mineral binder incorporated into the barrier ribs, and optionally into their base underlayer.

The conditions of the second step of the baking heat treatment are adjusted so that the barrier rib material is consolidated sufficiently, while still having a high porosity both for the base underlayer and for the barrier ribs; it has been found that baking carried out under these conditions causes almost no shrinkage.

The number of heat treatments to manufacture the tile according to the invention is found to be considerably reduced, since it is even possible to manufacture the tile with only a single heat treatment after the array of electrodes has been produced.

Since the tile according to the invention contains no specific dielectric layer interposed between the electrodes and the base underlayer, the heat treatment relating to this dielectric layer is dispensed with.

Using conventional organic binders which decompose below 480° C. and a mineral binder having a softening temperature low enough for the barrier ribs to be consolidated below 480° C. or at this temperature, it is even possible to produce the entire tile without exceeding 480° C., thereby making it possible, in the case of conventional sodium-lime glass tiles, to reduce, if not eliminate, any risk of the tile deforming during its manufacture; it will be recalled that any deformation of the tile results, in particular, in problems of misalignment between the various components of the rear tile and, depending on the structures, those of the front tile and problems of malfunction of the plasma panel.

The tile according to the invention as shown in FIG. 1, or according to another variant in FIG. 2, is therefore obtained; this tile is provided with at least one array of electrodes 11 and with an array of porous barrier ribs 17 made of mineral material, defining cells for the discharge regions of the panel, where, at the bottom of the cells, the electrodes 11 are covered with a porous base underlayer 18 based on a mineral material; in FIG. 1, the sides of the barrier ribs and the bottom of the cells are covered with phosphors 41; in FIG. 2, the phosphors are not shown.

The embodiment in FIG. 2 differs from that in FIG. 1 in that the barrier ribs have sloping sides which are not perpendicular to the plane of the tile and in that, outside the zones where it supports the barrier ribs, the base underlayer has a rounded surface resulting from its partial and irregular abrasion during the step of forming the barrier ribs.

It has been found that the base underlayer 18 according to the invention considerably improves the adhesion of the barrier ribs to the substrate.

The tiles according to the invention can be used in all types of plasma panel provided with barrier ribs defining cells or groups of cells.

Referring to FIG. 1, such a plasma image display panel, of the AC type and with a memory effect, comprises a first tile according to the invention, provided with barrier ribs 17 supported by the underlayer 18 already described, and a second tile 30 provided with coplanar electrodes 33, providing between them discharge regions 40 bounded by the barrier ribs 17; the electrodes 11 of the first tile, which serve for addressing the discharges, are entirely covered with the underlayer 18 according to the invention, at least in the active part of the panel; the coplanar electrodes 33 of the second tile 30, which serve for sustaining the discharges by the memory effect, are covered with a dielectric layer 32 and with an MgO-based protective layer 31.

The following example illustrates more particularly the invention and relates to the manufacture of a rear tile of a plasma panel.

EXAMPLE 1

An array of barrier ribs defining discharge regions having dimensions of 172 mm×100 mm was deposited according to the invention on a tile made of soda-lime glass having dimensions of 254 mm×162 mm and 3 mm in thickness, provided with an array of electrodes formed from aluminium conductors, the said barrier ribs being distributed over the tile with a pitch of 360 μm.

1.—Preparation of a base underlayer paste suitable for obtaining a dry green base underlayer containing (10.6%+3.3%) by weight of (organic binder+organic plasticizer) and suitable for obtaining a baked base underlayer having a porosity of greater than 25%:

preparation of an organic binder solution by dissolving 13 g of N4 grade ethyl cellulose in 83 g of terpineol and then the addition of 4 g of benzyl butyl phthalate in the form of the product with the reference number SANTICIZER 160;

dry preblending of a powder of mineral barrier rib material: the following were blended in a high-speed mixer:

mineral filler: 98 g of alumina; bimodal powder with 0.3 and 3 μm individual particles, the powder having a pressed density of 2.60 g/cm$^3$, mineral binder: 2 g of lead silicate containing 15% silica by weight; individual particles essentially between 0.5 and 2 μm; softening temperature: 380° C.;

dispersion of 100 g of powder of mineral barrier rib material in 95 g of the above solution of organic binder; and passing the dispersion through a three-roll mill so as to obtain a dispersion having a viscosity of around 37 000 mPa·s and, in this dispersion, aggregates of size less than 7 μm.

2.—Preparation of a main layer paste for the barrier ribs, suitable for obtaining a dry green main layer containing 3% by weight of organic binder and suitable for obtaining barrier ribs having a porosity of greater than 25%:

preparation of a solution of organic binder by dissolving 8 g of N4 grade ethyl cellulose resin in 92 g of terpineol;

dry preblending of a powder of mineral barrier rib material under the same conditions and with the same components as previously;

dispersion of 100 g of powder of material barrier rib mineral in 38.62 g of the above solution of organic binder; and passage of the dispersion through a three-roll mill so as to obtain a dispersion having a visosity of around 80 000 mPa·s and, in this dispersion, aggregates of size less than 7 μm.

3.—Deposition of the base underlayer:

A single screen-printing pass with the base underlayer paste, using a polyester fabric containing 48 yarns per cm, was carried out on that face of the tile which was provided with the array of electrodes and then the underlayer obtained was dried at 120° C. for 12 minutes in order to evaporate the solvent.

A green base underlayer with a dry thickness of around 18 μm was obtained.

4.—Deposition of the main barrier rib layer:

Four screen-printing passes with the main layer paste, using a polyester fabric containing 48 yarns per cm, and one screen-printing pass with the same paste, using a polyester fabric containing 90 yarns per mm, were carried out on the dried base underlayer, each pass being followed by a drying step at 120° C. for 12 minutes.

A green main layer with a dry thickness of around 110 μm was obtained.

5.—Application of a protective mask:

lamination of a photosensitive dry film 40 μm in thickness onto the main green barrier rib layer under the following conditions: temperature 110° C./pressure 4×10$^5$ Pa;

irradiation of the laminated film with 100 mJ/cm$^2$ using a mask formed from black lines having a thickness of 70 μm, this thickness corresponding to the desired width of the barrier ribs; and development of the irradiated film by means of an aqueous solution containing 0.2% by weight of $Na_2CO_3$ under the following conditions: temperature 30° C./pressure $1.5\times10^5$ Pa.

The green barrier rib layer was then covered with a protective mask made of polymer material provided with patterns corresponding to the array of barrier ribs to be formed.

6.—Blasting with abrasive material or "sandblasting":

abrasive material: metal particles: referenced S9, grade 1000, from Fuji;

conditions of employment of the abrasive material: use of a flat rectangular nozzle about 200 mm in length; distance between the output of the nozzle and the tile: 95 mm; flow rate of the abrasive material: 1800 g/min; direction of movement of the nozzle: perpendicular to that of the tile:

variant 1 for straight-sided barrier-rib structure: sandblasting pressure 0.035 MPa; rate of scanning over the tile by the nozzle: 50 mm/min; tile displacement speed: 110 mm/min;

variant 2 for a waffled barrier-rib structure: sandblasting pressure 0.035 Mpa; rate of scanning over the tile by the nozzle 50 mm/min; tile displacement speed 105 mm/min.

Result obtained: uniform etching of the barrier ribs with preservation of a residual layer of green material at the bottom of each cavity, the central thickness of which is slightly less than that of the base underlayer initially deposited; not one hole was observed in this residual layer and the surface of the underlying electrodes was not visible anywhere in the active part of the tile; compared with the barrier ribs obtained by sandblasting using a conventional process (stopping on a specific dielectric interlayer), it was found here that the base of the barrier ribs was more rounded, thereby favouring uniform distribution of the phosphors in the subsequent steps.

7.—Removal of the mask by stripping:

application to the mask of an aqueous solution containing 1% NaOH by weight at a temperature of about 35° C. and at a pressure of about $0.4\times10^5$ Pa;

rinsing with water; and drying with an air knife at 50° C.

8.—Preparation of the phosphor pastes

For each of the three phosphor powders—red green and blue:

use of an aqueous solution of a resin based on polyvinyl alcohol (PVA), having a viscosity of 300 mPa·s and made photosensitive by the addition of ammonium dichromate; and dispersion of 60 g of each phosphor in 100 g of PVA solution; addition of 7 g of $NH_4Cr_2O_7$+11 g of liquid additives, especially stabilizers, antifoams and brighteners.

9.—Deposition of the green layers of phosphors:

for each colour:

whole-area screen printing of the phosphor paste of this colour, using a fabric consisting of 71 yarns/cm, so as to form a dry coating approximately 15 μm in thickness, followed by drying of the green layer of phosphors at about 55° C. for 15 minutes;

irradiation of the green layer with 800 mJ/cm$^2$, in a pattern according to the desired distribution of the phosphors; and development of the irradiated layer by spraying water heated to a temperature of about 30° C., and a pressure of $2\times10^5$ Pa, followed by drying at 65° C. for about 15 minutes.

10.—Deposition of a seal around the perimeter of the tile

This seal is intended for joining the tile with another tile in order to form a plasma screen and to leave, between these tiles, discharge-tight spaces intended to be filled with discharge gas.

11.—Baking at 450° C., with a temperature hold lasting about 2 h 30 min.

During one and the same operation, the organic binder of the seal, of the base underlayer, of the main barrier rib layer and of the phosphor layers were thus removed; thanks to the mineral binder contained in the pastes for this underlayer and the barrier ribs, the barrier ribs and the underlayer were consolidated; the barrier ribs obtained had a porosity of greater than 25% and were supported and reinforced by the continuous underlayer according to the invention, which also had a porosity of greater than 25%; virtually no post-baking shrinkage was observed.

12.—Joining of a front tile to the tile thus obtained:

sealing of the two tiles joined together at 400° C., followed by pumping of the space lying between the tiles, under the conditions for obtaining a high vacuum; and filling of the panel with the discharge gas and sealing in order to close off the panel.

Thanks to the process according to the invention, a plasma panel tile provided with an array of barrier ribs formed by abrasion is therefore obtained by completely eliminating the additional steps of the processes according to the prior art relating to the application and the baking of a dielectric layer intended, inter alia, for acting as a layer to protect the electrodes while the barrier ribs are being formed by abrasion.

Moreover, the barrier ribs, although porous and narrow, are steady thanks to the underlayer according to the invention.

The 2$^{nd}$ example below completes the illustration of the invention:

EXAMPLE 2

The purpose of this example is to illustrate the advantage in using a polyvinyl alcohol as organic binder of the base underlayer, in step 1 of preparing the base underlayer paste and step 2 of preparing the main layer paste of the process that has just been described.

EXAMPLE 2A main layer with a binder based on ethyle cellulose with a resin content of 3% (solvent: terpineol); and base underlayer with a binder based on the same resin with a 10.6% content, softened by 3.3% of a plasticizer (solvent: terpineol).

In step 6 of blasting the abrasive material or of "sandblasting", a factor of 4 was found between the rate of abrasion of the main layer and that of the underlayer.

EXAMPLE 2B main layer with a binder based on ethyl cellulose with a resin content of 3% (solvent: terpineol) as in Example 1A;

underlayer with a binder based on polyvinyl alcohol (15% PVA), with no plasticizer added, in which underlayer a diazo sensitizer allowed UV crosslinking, and water as solvent.

The use of two different resins, for the main layer and for the underlayer, and more particularly the fact that the crosslinked polyvinyl alcohol is insoluble in terpineol prevented the underlayer from being partly redissolved at the time of application of the main layer; as a result, the bottom of the cavities between barrier ribs was advantageously flatter in Example 1B than in Example 1A.

In step 6 of blasting with abrasive material or "sandblasting", a factor of 16 between the rate of abrasion of the main layer and that of the underlayer was found.

From this it is deduced that the use of crosslinked polyvinyl alcohol is particularly advantageous for implementing the process of the invention.

The invention claimed is:

1. Tile for a plasma image display panel comprising a substrate coated with at least one array of electrodes which is itself coated with an array of barrier ribs made of a mineral material, the porosity of which is greater than 25%, these being intended to define cells in order to form discharge regions in the said panel, wherein it comprises a porous base underlayer which is inserted between the said array of electrodes and the said array of barrier ribs, the porous base underlayer being made of a mineral material, the porosity of which is greater than 25%.

2. Tile according to claim 1, wherein the width of the barrier ribs is less than or equal to 70 μm.

3. Tile according to claims 1, wherein the thickness of the said base underlayer is between 10 μm and 40 μm at every point of said tile.

4. Tile according to claim 1, wherein it includes no interlayer, especially no dielectric interlayer, between the electrodes and the said base underlayer.

5. Tile according to claim 1, wherein the base underlayer includes a component suitable for reflecting light.

6. Tile according to claim 1, wherein when the said mineral material of the base underlayer comprises a mineral filler and optionally a mineral binder, the proportion by weight of mineral binder in the mineral material of the base underlayer is less than 13%.

7. Tile according to claim 1, wherein the material of the base underlayer is identical to the material of the barrier ribs.

8. Tile according to claim 1, wherein it includes a layer of phosphors at least partly covering the sides of the barrier ribs and the said underlayer.

9. Tile according to claim 1, wherein, at every point on the surface joining the base of the barrier ribs to the base underlayer, the radius of curvature is greater than or equal to 10 μm.

10. Tile according to claim 1, wherein the said barrier ribs are themselves coated with an overlayer.

11. Plasma image display panel, of the AC type and with a memory effect, comprising a first tile according to claim 1 and a second tile provided with coplanar electrodes serving to sustain the discharges by the memory effect, providing between the tiles discharge regions bounded by the said barrier ribs.

12. Process for manufacturing a plasma panel tile according to claim 1, wherein it comprises the following steps:

formation of at least one array of electrodes on a substrate;

deposition, on the said array of electrodes and on the substrate, of at least a green base underlayer and a superposed green main layer, both the underlayer and the main layer being based on a powder blend of a mineral material and an organic binder;

blasting with an abrasive material:

≅so as to remove part of the said green main layer in order to form the said array of green barrier ribs, the said barrier ribs comprising a base, a top and sides, and ≅so as to avoid, if not limit, the removal of the said green base underlayer so that there is not one hole over the entire coating;

baking under conditions suitable for removing the organic binder and for consolidating the mineral material of the barrier ribs and of the said base underlayer, the composition and the thickness of the said green base underlayer being suitable for the rate of abrasion of this underlayer to be less than the rate of abrasion of the main layer under the conditions of the said blasting.

13. Process according to claim 12, wherein, when the said mineral material of the base underlayer comprises a mineral filler and optionally a mineral binder, the proportion by weight of mineral binder in the mineral material of the base underlayer is less than 13%.

14. Process according to claim 12, wherein the proportion of organic binder in the base underlayer is greater than the proportion of organic binder in the main layer.

15. Process according to claim 12, wherein the glass transition temperature of the organic binder of the base underlayer is below that of the organic binder of the main layer.

16. Process according to claim 12, wherein the organic binder of the said base underlayer and that of the said main layer are chosen from the group comprising cellulosic resins, acrylic resins, methacrylic resins, rosin resins and resins based on crosslinked polyvinyl alcohol.

17. Process according to claim 16, wherein the organic binder of the said base underlayer is based on polyvinyl alcohol.

18. Process according to claim 12, wherein it includes only a single baking heat treatment after at least one array of electrodes has been formed.

19. Process according to claim 12, wherein it includes no step during which the temperature of the tile exceeds 480° C.

20. Process according to claim 12, wherein the mineral filler of the base underlayer is identical to the mineral filler of the main barrier rib layer.

* * * * *